US005325277A

United States Patent [19]

Suzuki et al.

[11] Patent Number: 5,325,277

[45] Date of Patent: Jun. 28, 1994

[54] ELECTROLUMINESCENCE DEVICE AND ELECTRONIC PRINTING APPARATUS USING THE SAME

[75] Inventors: Teiichi Suzuki; Takashi Ozawa, both of Kanagawa, Japan

[73] Assignee: Fuji Xerox Co., Ltd., Tokyo, Japan

[21] Appl. No.: 943,540

[22] Filed: Sep. 11, 1992

[30] Foreign Application Priority Data

Sep. 13, 1991 [JP] Japan ..... 3-261459

[51] Int. Cl.[5] ..... F21V 9/16

[52] U.S. Cl. ..... 362/84; 362/92; 313/15; 313/506

[58] Field of Search ..... 362/84, 92; 313/14, 313/15, 506

[56] References Cited

U.S. PATENT DOCUMENTS

| | | | |
|---|---|---|---|
| 2,755,400 | 7/1956 | Stiles | 313/15 |
| 3,149,281 | 9/1964 | Lieb | 313/506 |
| 3,806,759 | 4/1974 | Kabaservice et al. | 313/506 |
| 3,919,589 | 11/1975 | Hanak | 313/506 |

FOREIGN PATENT DOCUMENTS 62-106479 5/1987 Japan .

OTHER PUBLICATIONS

"Thin Film Electroluminescent Edge Emitters for Solid State Imaging", Zoltan K. Kun, Solid State Technology, Jul. 1988, pp. 77-79.

"TFel Edge Emitter Array for Optical Image Bar Applications", Z. K. Kun et al, Proceedings of the SID, vol. 28/1, 1987, pp. 81-85.

*Primary Examiner*—Richard A. Bertsch
*Assistant Examiner*—Michael I. Kocharov
*Attorney, Agent, or Firm*—Finnegan, Henderson, Farabow, Garrett & Dunner

[57] ABSTRACT

An electroluminescence device which has a short light emission decay time and high light emission efficiency and an electronic printing apparatus which can print at a high speed using the electroluminescence device. The electroluminescence device comprises an electroluminescence element for emitting light when an AC voltage is applied thereacross, heating means for heating the electroluminescence element, and controlling means for controlling the heating means so as to start operation of the heating means after completion of application of the AC voltage across the electroluminescence element. The electronic printing apparatus comprises such an electroluminescence device, a photosensitive member, and optical means for focusing light from the electroluminescence element upon the photosensitive member.

7 Claims, 4 Drawing Sheets

INTENSITY
PRIOR ART
PRESENT INVENTION
(a)
t
VOLTAGE APPLIED TO EL ELEMENT
HIGH FREQUENCY AC PULSE SIGNAL
(b)
0
t
ENERGIZATION OF HEAT GENERATING RESISTOR MEMBER
T3
(c)
T1
T2
t

ELECTROLUMINESCENCE DEVICE AND ELECTRONIC PRINTING APPARATUS USING THE SAME

BACKGROUND OF THE INVENTION

1. Field of the Invention

This invention relates to an electroluminescence element which is used as a light source to which a photosensitive element is exposed in an electronic printing apparatus and an electronic printing apparatus employing the electroluminescence element, and more particularly to an electroluminescence device with a reduced delay from the end of the desired light emission period until the complete end of light emission, thus achieving a shorter overall light emission time, and also to an electronic printing apparatus which achieves high speed printing employing the electroluminescence device.

2. Description of the Prior Art

It is already known, as disclosed for example in Japanese Patent Laid-Open Application No. 62-106479 (1987) to employ an electroluminescence element as a light source for an electronic printing apparatus, that is, as a light source to which a photosensitive member is exposed.

FIG. 3 shows the variation in intensity of light emitted from an electroluminescence element in an electronic printing apparatus with respect to time when the electroluminescence element is energized. The time variation of the intensity of light emitted from an electroluminescence element in a conventional electronic printing apparatus will be described subsequently with reference to FIG. 3.

First, normally an AC drive signal is applied to an electroluminescence element, and the waveform (b) in FIG. 3 illustrates such a drive signal applied to the electroluminescence element. The drive signal is applied to the electroluminescence element for a period of time (up to time T1 in FIG. 3) which depends upon an exposure characteristics and so forth of the photosensitive member. Generally, an electroluminescence element has characteristics such that, when a drive signal as described above is applied to the electroluminescence element, the intensity of the electroluminescence element rises gradually and the electroluminescence element reaches its maximum intensity immediately before the application of the driving signal is stopped, as seen from the curve (a) of FIG. 3. Then, after the time T1, the brightness of the electroluminescence element decays gradually as shown by the solid line portion of the curve (a) of FIG. 3 from the time T1 to time T2 and a broken line portion from the time T2.

The demand for an electronic printing apparatus of a higher printing speed has been and is progressively increasing in recent years. In order to raise the printing speed, it is necessary on one hand to increase the intensity of the electroluminescence element and on the other hand to decrease the decay time of the electroluminescence element after emission of light, that is, to cause the intensity of the electroluminescence element to decrease as quickly as possible after the drive signal to the electroluminescence element is cut off, so as to eliminate unnecessary exposure of the photosensitive element to light.

An increase of the intensity of the electroluminescence element can be achieved comparatively easily by adjustment of the concentration of light emitting ions, selection of the dielectric material and so forth. There is no practical obstacle to adjustment of the light emitting ion concentration by these means.

On the other hand, it is known that the light emission decay time can be adjusted by changing the concentration of doping ions in the material forming the electroluminescence element which form the light-emitting centers. For example, when manganese (Mn) is used as a dopant at a concentration of 0.1% by weight in zinc sulfide (ZnS) which is commonly used as a material for an electroluminescence element, the light emission decay time of the electroluminescence element at room temperature is about 1 ms. Further, it is known that, when the concentration of manganese (Mn) is 1% by weight, the light emission decay time is about 0.3 ms. While the light emission decay time is directly related to proportion to the amount of manganese (Mn) dopant in this manner, it is known that, when ZnS is doped with Mn as described above, the light emission efficiency of the electroluminescence element reaches a maximum when the concentration of Mn is about 0.5% by weight, and as the doped amount of Mn increases, a phenomenon called concentration quenching occurs, and instead the light emission efficiency suddenly drops.

Accordingly, reduction of the light emission decay time and enhancement of the light emission efficiency of an electroluminescence element are conventionally contradictory demands, and actually, there is the problem that either one of the light emission decay time and the light emission efficiency must be sacrificed. When such an electroluminescence element is employed for an electronic printing apparatus, it imposes a limit to the printing speed, and particularly when the electroluminescence element is driven, for example, by an AC signal of 20 kHz, the printing time for a line of pixels is not less than 1 ms at the shortest. Accordingly, there is the problem that a medium or high speed electronic printing apparatus cannot be realized with an electroluminescence element.

SUMMARY OF THE INVENTION

It is an object of the present invention to provide an electroluminescence device which has a short light emission decay time and a high light emission efficiency.

It is another object of the present invention to provide an electronic printing apparatus which can print at a high speed using an electroluminescence device.

In order to attain the objects, according to one aspect of the present invention, there is provided an electroluminescence device which comprises an electroluminescence element for emitting light therefrom when an AC voltage is applied thereacross, heating means for heating the electroluminescence element, and controlling means for controlling the heating means so as to start operation of the heating means after completion of application of the AC voltage across the electroluminescence element.

Preferably, the heating means includes a heat generating resistor member formed integrally with the electroluminescence element. Preferably, the controlling means includes a switching element for controlling a voltage to be applied to the heat generating resistor member. Preferably, the electroluminescence element includes an insulating substrate, a lower electrode, a first insulating layer, a light emitting layer, a second insulating layer and an upper electrode laminated successively in this order from below, and the heat generating resistor member is disposed on the upper electrode of the electroluminescence element. Alternatively, preferably the electroluminescence element includes an insulating substrate, a lower electrode, a first insulating layer, a light emitting layer and a second insulating layer laminated successively in this order from below, and the heat generating resistor member is disposed on the second insulating layer of the electroluminescence element and serves also as an upper electrode of the electroluminescence element.

With this electroluminescence device, since the electroluminescence element is heated by the heating means after completion of application of the AC voltage across the electroluminescence element so that the incidence of non-radiative transitions of electrons in the electroluminescence element is increased by the heat thereby decreasing the intensity of light emitted, that is, increasing the overall transition probability of electrons and decreasing the relative incidence of radiative transitions, whereby the light emission decay time is reduced. Consequently, the electroluminescence device can have a light emission duration much shorter than that of a conventional electroluminescence device.

According to another aspect of the present invention, there is provided an electronic printing apparatus which comprises an electroluminescence device including an electroluminescence element for emitting light therefrom when an AC voltage is applied thereacross, heating means for heating the electroluminescence element, and controlling means for controlling the heating means so as to start operation of the heating means after completion of application of the AC voltage across the electroluminescence element, a photosensitive member, and optical means for focusing light from the electroluminescence element upon the photosensitive member.

Since the electronic printing apparatus is constructed using the electroluminescence device having an electroluminescence element which has a light emission decay time reduced by the heating means as described above, it can print at a higher speed than a conventional electronic printing apparatus which is constructed using a conventional electroluminescence device.

According to a further aspect of the present invention, there is provided an electroluminescence device which comprises an electroluminescence element for emitting light when an AC voltage is applied thereacross, and heating means for heating the electroluminescence element immediately after completion of application of the AC voltage across the electroluminescence element.

Also with this electroluminescence device, since the electroluminescence element is heated by the heating means after completion of application of the AC voltage across the electroluminescence element so that the incidence of non-radiative transitions of electrons in the electroluminescence element is increased by the heat thereby decreasing the intensity of light emitted, that is, increasing the overall transition probability of electrons and decreasing the relative incidence of radiative transitions, whereby the light emission decay time is reduced. Consequently, the electroluminescence device can have a light emission duration much shorter than that of a conventional electroluminescence device.

The above and other objects, features and advantages of the present invention will become apparent from the following description and the appended claims, taken in conjunction with the accompanying drawings in which like parts or elements are denoted by like reference characters.

DETAILED DESCRIPTION OF THE PREFERRED EMBODIMENTS

Figure 1:
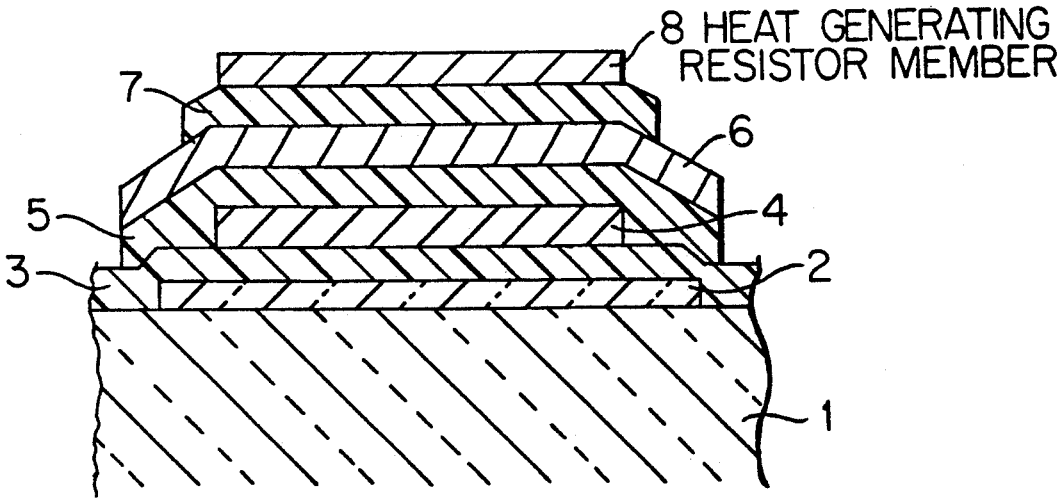
FIG. 1 is a schematic vertical sectional view of an electroluminescence element to which the present invention is applied.

Referring first to FIG. 1, there is shown in vertical section an electroluminescence element to which the present invention is applied. The electroluminescence element shown includes an insulating substrate 1 made of a light transmitting material such as glass, and further includes an electroluminescence lower electrode 2, a first insulating layer 3, an electroluminescence light emitting layer 4, a second insulating layer 5, an electroluminescence upper electrode 6, a third insulating layer 7 and a heat generating resistor member 8 laminated successively in this order from below on the insulating substrate 1.

The electroluminescence element has basically the same construction as a conventional electroluminescence element except for the heat generating resistor member 8, and accordingly, detailed description of the electroluminescence element is omitted and only an outline of the same will be described herein. In particular, the electroluminescence lower electrode 2 is a transparent electrode made of indium tin oxide (ITO). The first, second and third insulating layers 3, 5 and 7 are all formed from a same insulating material, that is, SiNx. It is to be noted that SiNx as an insulating material may be replaced by $SiO_2$, $Al_2O_3$, $Y_2O_3$, $Ta_2O_5$ or the like. Further, the electroluminescence light emitting layer 4 in the present embodiment is made of ZnS:Mn. However, it may otherwise be made of any of ZnS:Tb, F, SrS:Ce, CaS:Eu and so forth or else it may be a composite film of any of these.

The heat generating resistor member 8 is preferably made of a material having characteristics such that it can be heated to a high temperature in a short period of time, and particularly, a cermet material such as $TaSiO_2$, a tantalum compound such as $Ta_2N$ or a nichrome material is suitable as the material. When a plurality of electroluminescence elements are disposed to construct an electroluminescence device, the heat generating resistor member 8 may be formed either discretely for each of the electroluminescence elements or in the form of a strip common to the electroluminescence elements.

Figure 2:
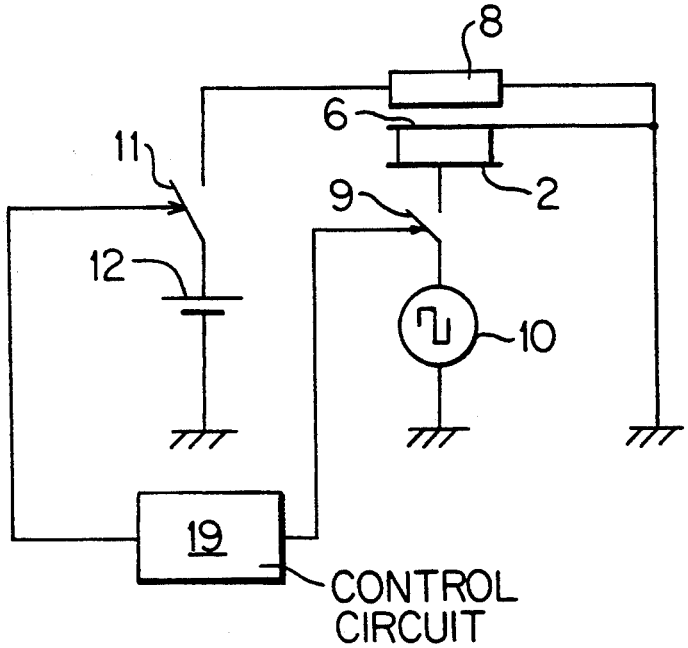
FIG. 2 is a schematic circuit diagram illustrating electric connections to the electroluminescence element shown in FIG. 1.

Referring now to FIG. 2, there are illustrated electric connections to the electroluminescence element described above. Since the electroluminescence element has the same basic construction as a conventional electroluminescence element as described hereinabove except the heat generating resistor member 8, driving thereof is not particularly different from that of a conventional electroluminescence element. Thus, for example, the electroluminescence lower electrode 2 is connected to one end of an AC drive power source 10 by way of a drive switch 9, and the other end of the AC drive source 10 is grounded. Meanwhile, the electroluminescence upper electrode 6 is connected to an end of the heat generating resistor member 8 and is grounded. The other end of the heat generating resistor member 8 is connected to the positive electrode of a DC power source 12 by way of a quenching switch 11, and the negative electrode of the DC power source 12 is grounded. Here, the AC drive power source 10 outputs a pulse signal, and the frequency thereof is set to an optimum frequency within the range of 2 to 100 kHz depending on the material of the electroluminescence light emitting layer 4. A controlling circuit 19 counts clock pulses and controls the drive switch 9 and the quenching switch 11 at predetermined times in the manner described below.

Figure 3:
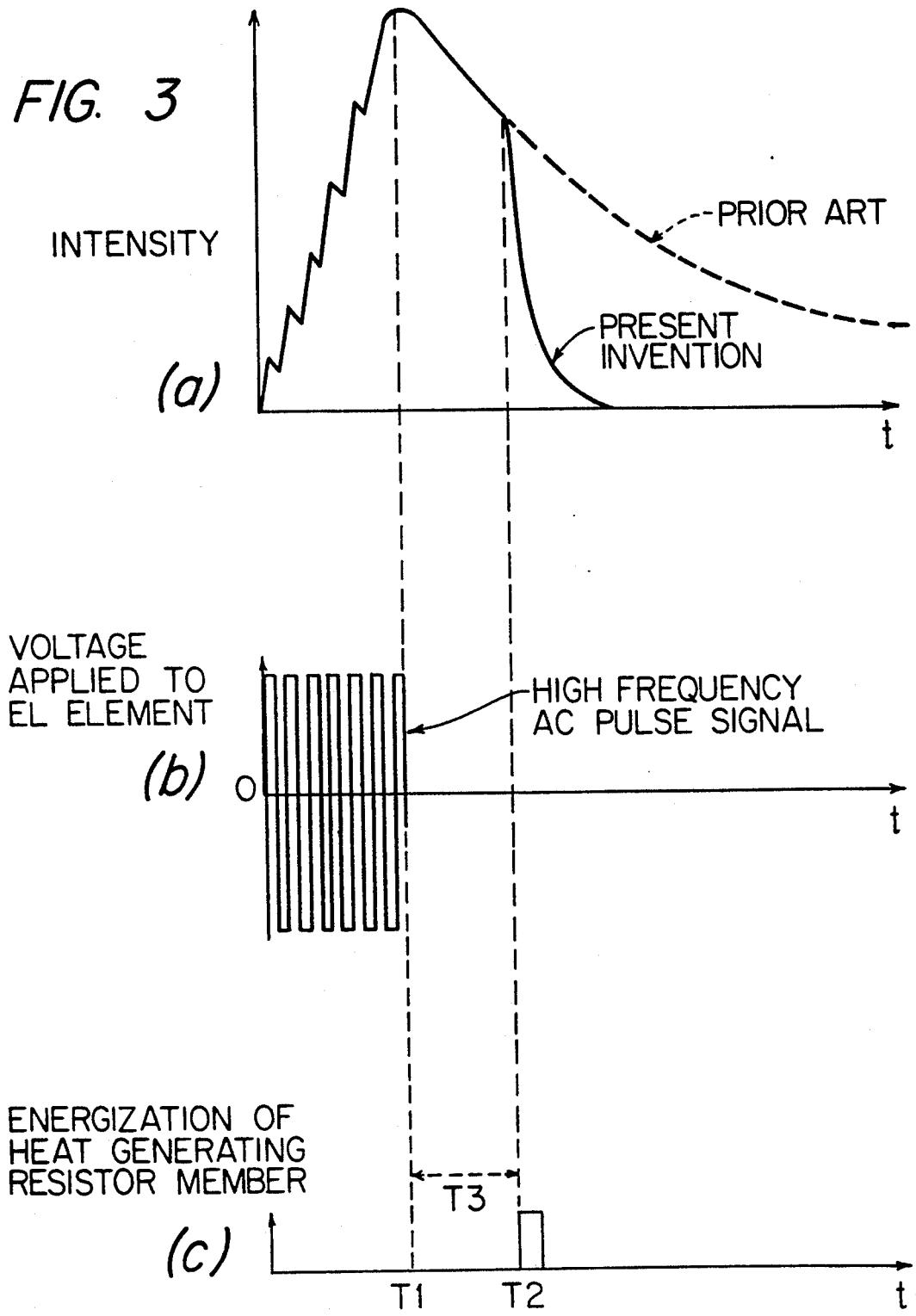
FIG. 3 is a diagram illustrating the relationship between drive timing and the intensity of emitted light of the electroluminescence element shown in FIG. 1.

When the drive switch 9 is closed by the controlling circuit 19, the AC pulse signal shown by the waveform (b) in FIG. 3, is applied between the electroluminescence upper electrode 6 and the electroluminescence lower electrode 2 for the period of time from t=0 to t=T1 for which the drive switch 9 is kept closed. The application time T1 is set in advance in accordance with the light emitting characteristics of the electroluminescence element and the photo-sensitive characteristics and so forth of the photosensitive member which is exposed to the light emitted from the electroluminescence element. As the AC signal is applied to the electroluminescence element, the intensity of the electroluminescence element increases gradually and reaches its highest level immediately before the time T1 (refer to the curve (a) in FIG. 3). Next, when the drive switch 9 is opened, at time T1, by the controlling circuit 19 so that the application of the AC signal is stopped, the intensity of the electroluminescence element thereafter decreases gradually. Here, if the electroluminescence element is of the conventional type which does not include a heat generating resistor member 8, the intensity of the electroluminescence element after time T1 will decrease, comparatively slowly as indicated by the broken line in curve (a) in FIG. 3 even beyond time T2.

Consequently, even at the time T2 at which light emission is required to stop, the intensity of the electroluminescence element still remains high enough that the photosensitive member in the electronic printing apparatus will be exposed to more light than required. Accordingly, the electroluminescence element can be operated for the next printing operation only after a further period of time has elapsed from time T2 until the intensity decreases sufficiently, which provides a limit to the printing speed.

With the electroluminescence element of the present embodiment, however, at the time T2 at which light emission is required to stop, the quenching switch 1 is closed by the controlling circuit 19 to apply a DC voltage to the heat generating resistor member 8. Consequently, the heat generating resistor member 8 generates heat, rising to a temperature, for example, of 200° C. to 400° C. in a very short period of time. The heat is transmitted to the electroluminescence light emitting layer 4 by way of the electroluminescence upper electrode 6 and the third insulating layer 7. As a result, the intensity of the electroluminescence element decreases rapidly from the time T2 and reaches a completely extinguished condition in a very short period of time as shown by the solid line of the curve (a) in FIG. 3.

Figure 4:
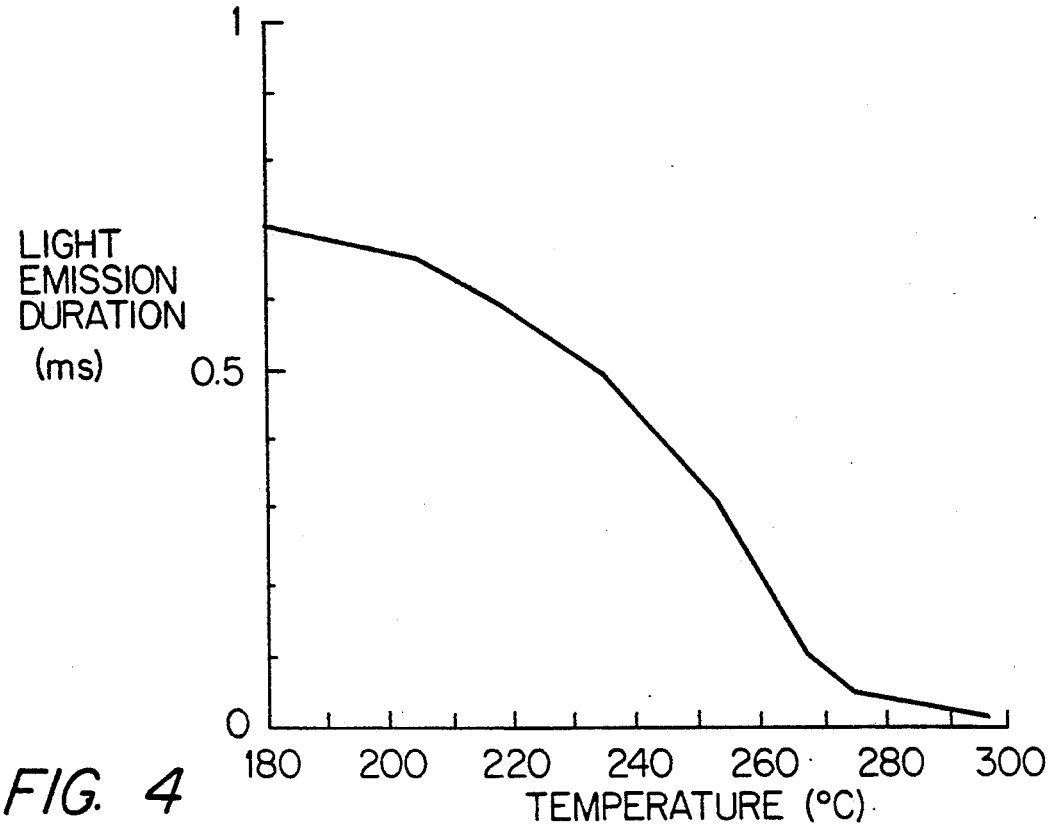
FIG. 4 is a diagram illustrating the relationship between temperature and light emission duration of an electroluminescence element.

The fact that the light emission decay time of the electroluminescence element is decreased by heating the electroluminescence element in this manner is thought to be due to the following mechanism. It is commonly known that the light emission time constant (the time required before the intensity of emitted light decays to a predetermined value) of the ions forming the light-emitting centers of light of the electroluminescence element depends upon the relationship between the excitation levels contributing to emission of light by the ions and the quantum lattice vibration (phonon) of the host crystal. More particularly, it is considered that, since at high temperature, electrons in an excited state frequently undergo, diffusion by lattice vibration, the incidence of non-radiative transitions greatly exceeds the incidence of radiative transitions and the transition incidence of the entire electroluminescence element is increased, resulting in a reduction of the intensity of emitted light and a reduction in the light emission decay time. FIG. 4 illustrates the results of tests of the relationship between temperature and the light emission duration of an electroluminescence element. As seen from FIG. 4, the light emission duration of the electroluminescence element decreases as the temperature of the electroluminescence element rises, and at a temperature of, for example, 300° C. or so, the light emission duration is reduced to about 30 μs or so.

Accordingly, in the embodiment described above, since the total (radiative and non-radiative) transition probability of electrons in the electroluminescence element is increased to reduce the light emission duration by heating the electroluminescence element by means of the heat generating resistor element immediately after completion of driving of the electroluminescence element, the time interval required before the electroluminescence element is operated again is short, which makes high speed operation of the electroluminescence element possible. Consequently, an electronic printing apparatus having a high printing speed can be realized readily by employing such an electroluminescence element.

Figure 5:
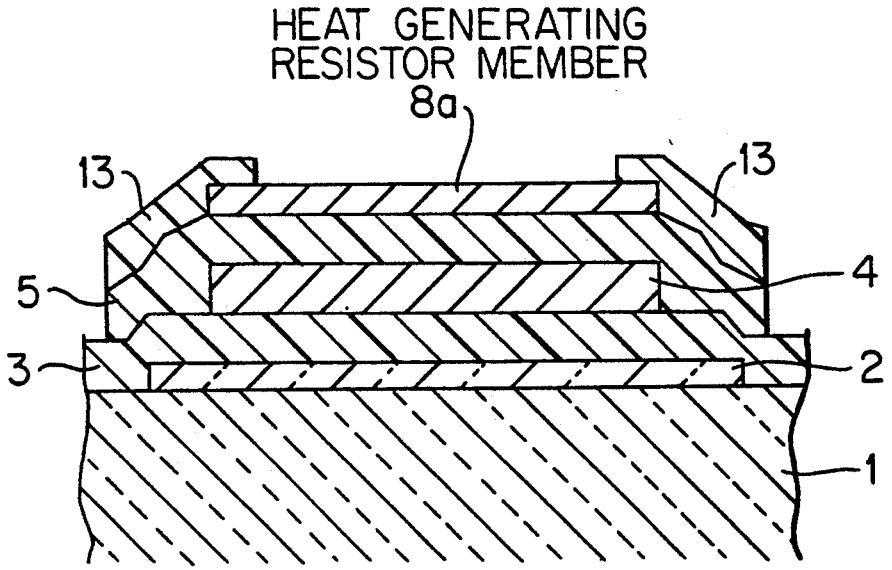
FIG. 5 is a schematic vertical sectional view of another electroluminescence element to which the present invention is applied.

Referring now to FIG. 5, there is shown another electroluminescence element to which the present invention is applied. The electroluminescence element of the present embodiment is a modification to and is principally different from the electroluminescence element shown in FIG. 1 in that a heat generating resistor member 8*a* serves also as one of a pair of electrodes between which an electroluminescence light emitting layer is held.

Figure 6:
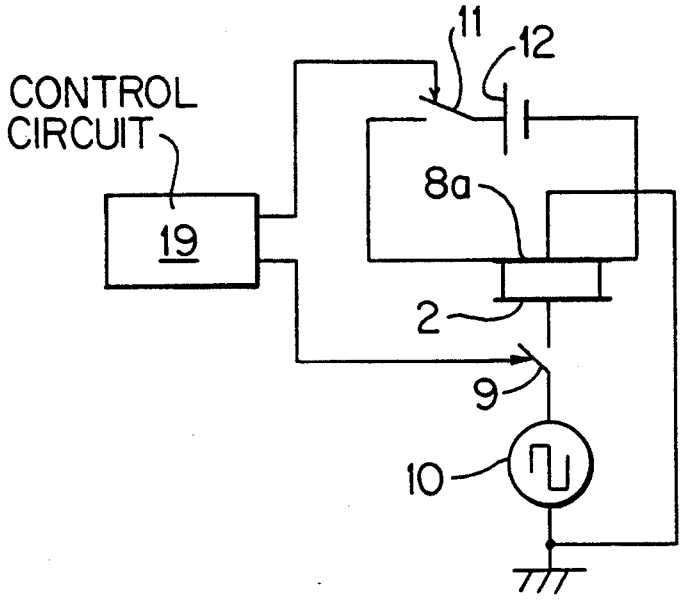
FIG. 6 is a schematic circuit diagram illustrating electric connections to the electroluminescence element shown in FIG. 5.

In particular, the heat generating resistor member 8*a* is laminated on the electroluminescence light emitting layer 4 with the second insulating layer 5 interposed therebetween. Further, an electroluminescence connecting electrode 13 is laminated such that it extends from an end portion of the heat generating resistor member 8*a* to the second insulating layer 5. Referring to FIG. 6, the heat generating resistor member 8*a* is connected to an end of the AC drive power source 10 series with the DC power source 12 by way of the quenching switch 11. Due to the construction of the electroluminescence element, the third insulating layer 7 and the electroluminescence upper electrode 6 of the electroluminescence element described hereinabove with reference to FIG. 1 are eliminated from the electroluminescence element of the present embodiment. Consequently, the electroluminescence element of the present embodiment is simplified in construction and has a short light emission duration and high light emission efficiency.

It is to be noted that, while the heat generating resistor member 8*a* in the present embodiment serves also as the electroluminescence upper electrode 6, naturally it may otherwise serve not as the electroluminescence upper electrode but as the electroluminescence lower electrode. Further, a transparent electrode made of indium tin oxide (ITO) and employed as an electroluminescence upper electrode may be used by itself as a heat generating resistor member. Further, while the electroluminescence elements of the embodiments described above are of the surface emission type, they are not necessary limited to this specific type but may be of some other type such as the edge emission type. In the latter case, the electroluminescence lower electrode 2 disposed on the insulating substrate 1 in either of FIGS. 1 and 5 need not necessarily be a transparent electrode but may be formed of an opaque metal such as chromium, tantalum, molybdenum or aluminum.

Figure 7:
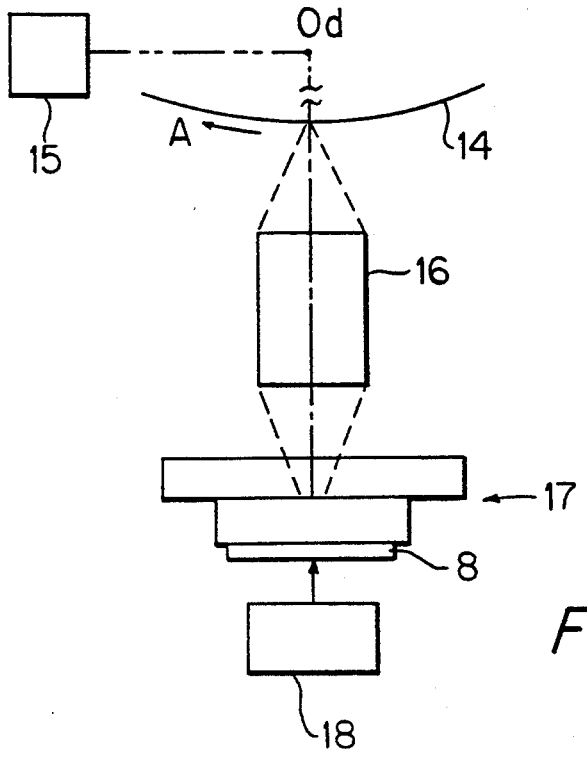
FIG. 7 is a schematic block diagram illustrating the general construction of an electronic printing apparatus employing an electroluminescence element according to the present invention.

Referring now to FIG. 7, there is shown the general construction of principal portions of an electronic printing apparatus constructed employing either of the electroluminescence elements described above with reference to FIGS. 1 and 5. The electronic printing apparatus shown includes a rotary drum 14, a rotational drive circuit 15 for rotating the rotary drum 14, an optical system 16, an electroluminescence device 17 and an electroluminescence drive circuit 18 for driving the electroluminescence device 17. The rotary drum 14 is cylindrical and has a photosensitive surface. The rotary drum 14 is disposed for rotation, in the direction indicated by arrow A in FIG. 7 around the axis Od. The rotary drum 14 is driven by the rotational driving circuit 15 by way of a known mechanism (not shown) including, for example, a motor, a transmission gear mechanism interposed between the motor and the rotary drum 14 and an energizing circuit for the motor.

The electroluminescence device 17 extends in a direction perpendicular to the plane of FIG. 7 such that the longitudinal direction thereof coincides with the longitudinal direction of the rotary drum 14. The electroluminescence device 17 is composed of a plurality of electroluminescence elements, which may be, for example, such electroluminescence elements as described hereinabove with reference to FIG. 1, disposed in a row extending in the direction perpendicular to the plane of FIG. 7 such that each of the electroluminescence elements corresponds to one pixel column of the photosensitive layer on the rotary drum 14. It is to be noted that the electroluminescence elements are shown in a simplified form in FIG. 7. The optical system 16 is interposed between the electroluminescence device 17 and the rotary drum 14 so that light emitted from the electroluminescence device 17 is focused on the surface of the rotary drum 14. The electroluminescence drive circuit 18 is provided to drive the electroluminescence elements constituting the electroluminescence device 17 and energize the heat generating resistor member 8 and includes an AC drive power source and DC power source (not shown). Basic operation of the electroluminescence driving circuit 18 is not fundamentally different from the basic operation of the circuit described hereinabove with reference to FIG. 2, and accordingly, overlapping description thereof is omitted herein.

With the electronic printing apparatus, since each of the electroluminescence elements constituting the electroluminescence device 17 is constructed such that the electroluminescence element is heated after operation by the heat generating resistor member disposed integrally thereon to decrease the light emission duration, the electronic printing apparatus can print at a higher speed than a conventional electronic printing apparatus.

It is to be noted that, while the heat generating resistor member 8 or 8*a* is disposed integrally with the electroluminescence element described hereinabove with reference to FIG. 1 or 5, it need not necessarily be disposed integrally but may be disposed as a separate member at a position spaced by some distance from the electroluminescence element, as long as heat from the heat generating resistor member 8 is transmitted to the electroluminescence element.

Having now fully described the invention, it will be apparent to one of ordinary skill in the art that many changes and modifications can be made thereto without departing from the spirit and scope of the invention as set forth in the appended claims herein.

What is claimed is:

1. An electroluminescence device, comprising:

an electroluminescence element for emitting light therefrom when an AC voltage is applied thereacross;

heating means for heating said electroluminescence element; and controlling means for controlling said heating means so as to start operation of said heating means after completion of application of the AC voltage across said electroluminescence element.

2. An electroluminescence device according to claim 1, wherein said heating means includes a heat generating resistor member formed integrally with said electroluminescence element.

3. An electroluminescence device according to claim 2, wherein said controlling means includes a switching element for controlling a voltage to be applied to said heat generating resistor member.

4. An electroluminescence device according to claim 2, wherein said electroluminescence element includes an insulating substrate, a lower electrode, a first insulating layer, a light emitting layer, a second insulating layer and an upper electrode laminated successively in this order from below, and said heat generating resistor member is disposed on said upper electrode of said electroluminescence element.

5. An electroluminescence device according to claim 2, wherein said electroluminescence element includes an insulating substrate, a lower electrode, a first insulating layer, a light emitting layer and a second insulating layer laminated successively in this order from below, and said heat generating resistor member is disposed on said second insulating layer of said electroluminescence element and serves also as an upper electrode of said electroluminescence element.

6. An electronic printing apparatus, comprising:

an electroluminescence device including an electroluminescence element for emitting light when an AC voltage is applied thereacross, heating means for heating said electroluminescence element, and controlling means for controlling said heating means so as to start operation of said heating means after completion of application of the AC voltage across said electroluminescence element; and a photosensitive member.

7. A method of producing light in an electroluminescence device including an electroluminescence element and a heating means for heating the electroluminescence element, comprising the steps of:

applying an AC voltage across the electroluminescence element to cause the electroluminescence element to produce light; and terminating the application of the AC voltage;

energizing the heating means immediately after terminating the application of the AC voltage to heat the electroluminescence element, thereby to reduce a light emission decay time of the electroluminescence element.

* * * * *